US008314381B2

(12) United States Patent
Bisling

(10) Patent No.: US 8,314,381 B2
(45) Date of Patent: Nov. 20, 2012

(54) REFLECTOR FOR A TIME-OF-FLIGHT MASS SPECTROMETER

(75) Inventor: Peter Bisling, Reinbek (DE)

(73) Assignee: Helmholtz-Zentrum Geesthacht Zentrum für Material-und Küstenforschung GmbH, Geesthacht (DE)

( * ) Notice: Subject to any disclaimer, the term of this patent is extended or adjusted under 35 U.S.C. 154(b) by 119 days.

(21) Appl. No.: 13/011,038

(22) Filed: Jan. 21, 2011

(65) Prior Publication Data

US 2011/0186730 A1 Aug. 4, 2011

(30) Foreign Application Priority Data

Jan. 29, 2010 (EP) ..... 10152072

(51) Int. Cl.
*H01J 49/40* (2006.01)
*H01J 49/22* (2006.01)

(52) U.S. Cl. ..... 250/287; 250/396 R

(58) Field of Classification Search ..... 250/281, 250/282, 287, 396 R
See application file for complete search history.

(56) References Cited

U.S. PATENT DOCUMENTS

| | | | | |
|---|---|---|---|---|
| 4,731,532 | A * | 3/1988 | Frey et al. | 250/287 |
| 5,017,780 | A * | 5/1991 | Kutscher et al. | 250/287 |
| 5,065,018 | A * | 11/1991 | Bechtold et al. | 250/287 |

FOREIGN PATENT DOCUMENTS

| | | | |
|---|---|---|---|
| DE | 3524536 | A1 | 1/1987 |
| EP | 0373550 | A2 | 6/1990 |
| GB | 2455977 | A | 7/2009 |
| WO | WO-03073086 | A1 | 9/2003 |
| WO | WO 03073086 | A1 * | 9/2003 |

OTHER PUBLICATIONS

Search Report for European Patent Application No. 10 15 2072 dated Jun. 29, 2010.

* cited by examiner

*Primary Examiner* — Robert Kim
*Assistant Examiner* — David E Smith
(74) *Attorney, Agent, or Firm* — Marshall, Gerstein & Borun LLP

(57) ABSTRACT

A reflector for a time-of-flight mass spectrometer for reflecting ionized atoms and/or molecules, with an entry opening and with an arrangement of successively arranged ring electrodes extending away from the entry opening along a longitudinal axis of the reflector is illustrated and described, as is a time-of-flight mass spectrometer. The object of providing a reflector for a time-of-flight mass spectrometer or providing such a mass spectrometer, with improved mass resolution at a high detection probability, is achieved by virtue of the fact that the ring electrode closest to the entry opening serves as a correction electrode and is at an opposite electric potential compared to the other ring electrodes, that a screening electrode is provided on the side of the entry opening facing away from the ring electrodes and that the screening electrode lies at a potential that differs from that of the ring electrodes, more preferably at earth potential.

20 Claims, 5 Drawing Sheets

REFLECTOR FOR A TIME-OF-FLIGHT MASS SPECTROMETER

FIELD OF THE INVENTION

The present invention relates to a reflector for a time-of-flight mass spectrometer for reflecting ionized atoms and/or molecules, with an entry opening and with an arrangement of successively arranged ring electrodes extending away from the entry opening along a longitudinal axis of the reflector, and to a time-of-flight mass spectrometer.

BACKGROUND

The use of so-called mass spectrometers to analyse the chemical composition of different types of samples in particular has been known for a long time; these analyse the sample material in respect of the distribution of the atomic/molecular weights. In this context, use is often made of so-called time-of-flight mass spectrometers, in which the atoms/molecules of the material to be analysed is ionized at first and then accelerated with the aid of electric fields, with a predetermined amount of kinetic energy being imparted on the atoms/molecules. Here the time of flight, which is the time the ions require to reach a detector from the point at which they are ionized, is measured, with the ionization possibly not being brought about continuously, but in a pulsed fashion, for example with the aid of laser pulses such that there is a defined start time for the time-of-flight measurement.

The time of flight required by the ionized atoms/molecules for the predetermined path length is a measure for the mass thereof because, at a fixed prescribed kinetic energy, those atoms/molecules with a great mass will require a longer period of time than light ones for covering the path length.

In order now to increase further the mass resolution of such a time-of-flight mass spectrometer, it was found to be advantageous to insert a so-called reflector along the path length covered by the ionized atoms/molecules. Here, the accelerated, ionized atoms/molecules (ions) firstly move towards the reflector, are decelerated therein and are then accelerated out of the reflector again in the opposite movement direction and in the direction of the detector. The reflector operates using an electrostatic field that has the same polarity as the charge state of the flowing-in ions.

In this context, work was firstly undertaken with a so-called net reflector, in which the electrodes are embodied in a net-like shape, which, inter alia, is connected with the advantage that the electrostatic field of the reflector does not extend beyond the volume thereof into the drift path along which the ions move to the detector. However, such net electrodes are connected with the disadvantage that some of the ions passing through the reflector are scattered by the net electrodes or are deflected by the electrostatic near fields of the nets, and thus no longer reach the detector. This in turn results in a decrease in the detection probability.

It is for this reason that use is made of reflectors with net-less ring electrodes, in which the electrodes are arranged along a common axis. This prevents the ions from being able to contact the electrodes in the reflector, and so, compared to net electrodes, this leads to increased transmission and hence an increased detection probability. DE 35 24 536 A1 has disclosed a time-of-flight mass spectrometer with such a reflector.

However, a disadvantage of such reflectors is that the drift paths, along which the ions move, in such a ring electrode arrangement are not free from field gradients. However, it is precisely assumed that ions with the same atomic/molecular weight are in a field-gradient-free region outside of the reflector and therefore have a constant speed. An edge field, which extends out of the reflector and into the actually field-gradient-free space results in a reduction in the mass resolution of the time-of-flight mass spectrometer.

In the case of reflectors with net-free electrodes, the penetration of the field within the reflector into the per se field-gradient-free drift path can in principle also be minimized by virtue of the fact that the diameter of the entry opening or the first ring electrode is kept very small. However, this reduces the range of the acceptance angle for the ions to be detected and in turn results in the number of ions entering the reflector, and hence, overall, the detection probability, being reduced due to higher transmission losses.

SUMMARY

Using this prior art as a starting point, the object of the present invention therefore is the provision of a reflector for a time-of-flight mass spectrometer or the provision of such a time-of-flight mass spectrometer, with improved mass resolution at a high detection probability.

This object is achieved by virtue of the fact that the ring electrode closest to the entry opening is at an opposite electric potential compared to the other ring electrodes, that a screening electrode is provided on the side of the entry opening facing away from the ring electrodes and that the screening electrode lies at a potential that differs from that of the ring electrodes, more preferably at earth potential.

As a result of the ring electrode with the opposite potential, acting as a correction electrode, and the screening electrode, the drift paths for the ions outside of the reflectors are indeed largely field gradient free and the electric field within the reflector has no influence on the ion movement within these regions, and so the ions are neither accelerated nor decelerated. This increases the mass dispersion caused by the different speeds of the ions with different atomic/molecular weights, and leads to an improvement in the mass resolution.

The idea of the correction electrode is based on the notion of suppressing the field penetration into the per se field-gradient-free drift paths without having obstructions in the region of the ion trajectories. The disturbances instead are avoided with the aid of an electric field.

Hence the field from the reflector can be prevented from penetrating the gradient-field-free region of the drift paths even without a reduction in the size of the entry opening.

If the entry opening has an enlarged design, the ions can still be incident on the reflector at a relatively large angle relative to the longitudinal axis of the reflector and are nevertheless reflected without great losses. This means that the drift paths, along which the ions can move towards the reflector and away from the latter, can include a relatively large angle. The dimensions of the ion source and the mass spectrometer detector perpendicular to the direction defined by the drift paths are substantially fixed, and so the minimum spacing of these elements is also prescribed. If there now likewise is a larger maximum angle of incidence and angle of reflection, or a larger maximum angle that can be included by the drift paths as a result of the larger direction of incidence, the ion source and detector can be arranged closer to the reflector, and so the invention can reduce the installation size of the mass spectrometer, with the mass resolution being improved.

The magnitude of the electric voltage with which the correction electrode is supplied can largely be selected freely, and so this parameter is still available to optimize the angle divergence of the ion beam, reflected in the reflector, to the detector geometry. For ions with a kinetic energy of 1 kiloelectronvolt (keV), the voltage for supplying the ring electrode closest to the entry opening is preferably between −1 kilovolt (kV) and −4 kV.

The influence of the electric fields generated in the reflector is further reduced by the screening electrode, which lies at the potential of the field-gradient-free space for the drift paths, preferably at earth potential, and which is arranged on the side of the entry opening facing away from the ring electrodes.

In a preferred embodiment, the ring electrodes have an aperture opening, with the aperture opening of the ring electrode closest to the entry opening being greater than that of the other ring electrodes. Such an arrangement brings about the effect that, on the one hand, the field of the further ring electrodes, which lie at a positive potential for the positively charged ions, is prevented from extending into the region of the drift paths. On the other hand, the acceleration effect of the further ring electrodes is not affected too strongly by the ring electrode closest to the entry opening.

In order to bring about a spatially even effect of the screening electrode, the latter preferably has an annular design with an opening and extends in a plane running perpendicular to the longitudinal axis of the reflector. Here the through-hole of the screening electrode is prefereably less than or equal to the aperture opening of the ring electrode closest to the entry opening such that the screening electrode achieves a strong enough effect. Moreover, the distance between the screening electrode and the ring electrode closest to the entry opening can be adjustable in order thereby to improve the focussing of the ion beam leaving the reflector.

Provision is made in a preferred embodiment of the reflector for a mount, which surrounds the entry opening, and the screening electrode is attached to the mount, wherein such an arrangement can easily be assembled. Here the mount can likewise lie at earth potential.

Moreover, the aforementioned object is achieved by a time-of-flight mass spectrometer with an ion source for ionizing atoms and/or molecules, with an electrode arrangement, which may comprise a repeller electrode and a drain electrode, for accelerating ionized atoms and/or molecules in a first direction with the aid of electric fields, with an electrostatic reflector, embodied as described above, for reflecting the ionized atoms and/or molecules travelling along the first direction into a second direction, in which the reflector is arranged such that the longitudinal axis of the reflector bisects the angle between the first and the second direction, and with a detector arranged along the second direction for detecting the incidence of the ionized atoms and/or molecules. In the process, the advantages described in conjunction with the reflector are obtained.

BRIEF DESCRIPTION OF THE DRAWINGS

In the following text, the present invention will be explained on the basis of a drawing, which merely illustrates one preferred exemplary embodiment and in which.

DETAILED DESCRIPTION

Figure 1:
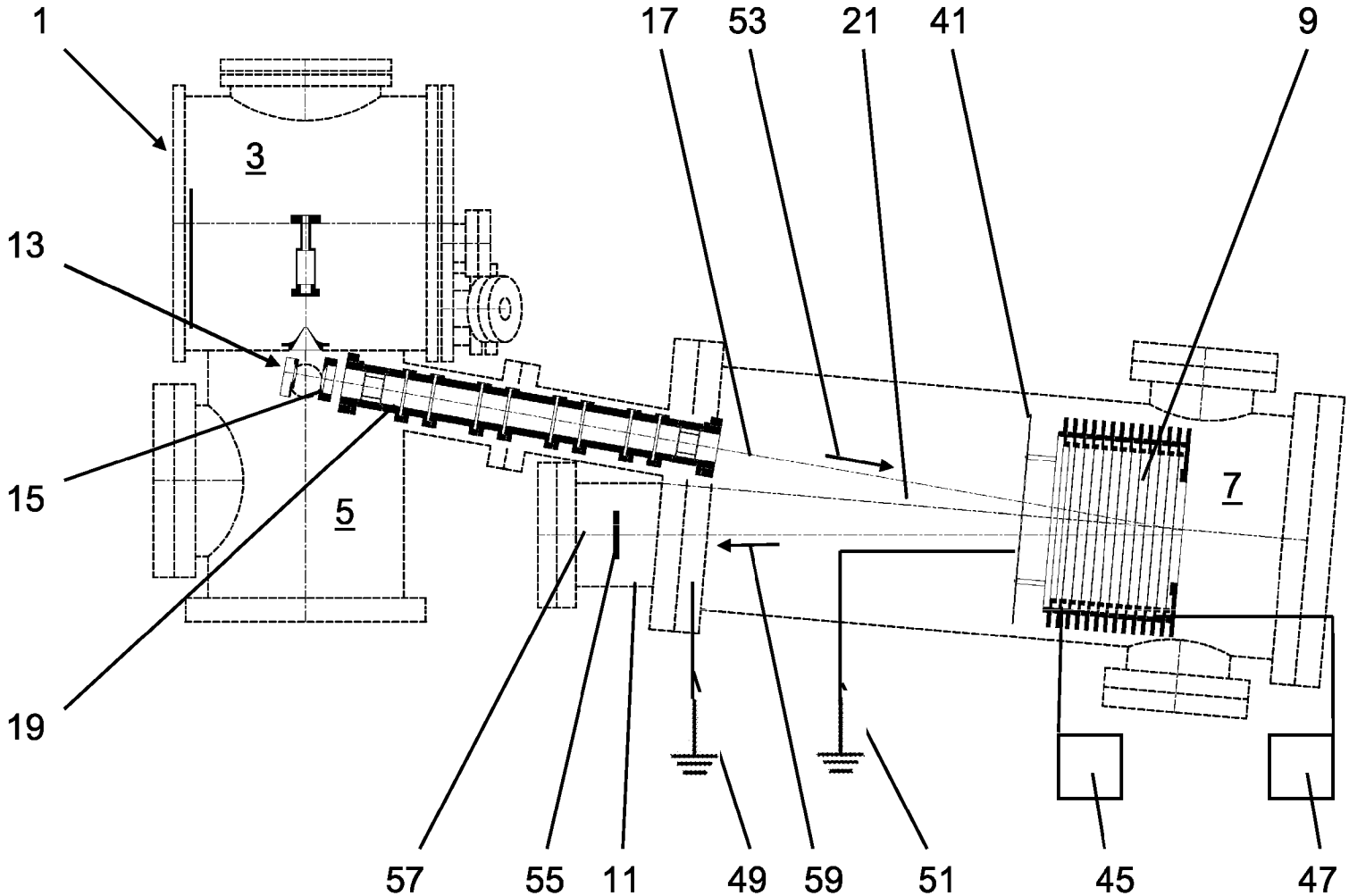
FIG. 1 shows a sectional view of an exemplary embodiment of a time-of-flight mass spectrometer according to the invention.
Figure 2:
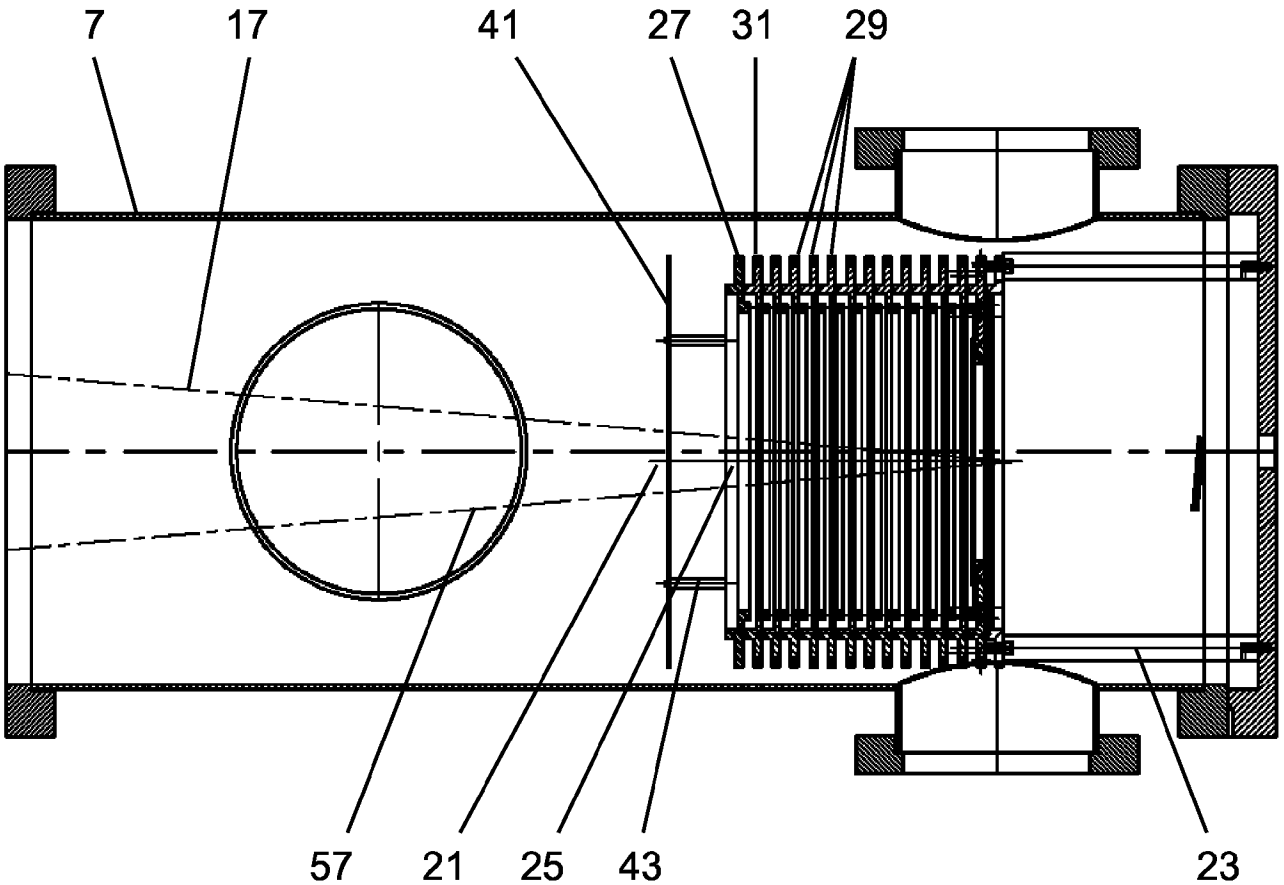
FIG. 2 shows a longitudinal sectional view of the part of the time-of-flight mass spectrometer from FIG. 1 with the reflector.
Figure 3:
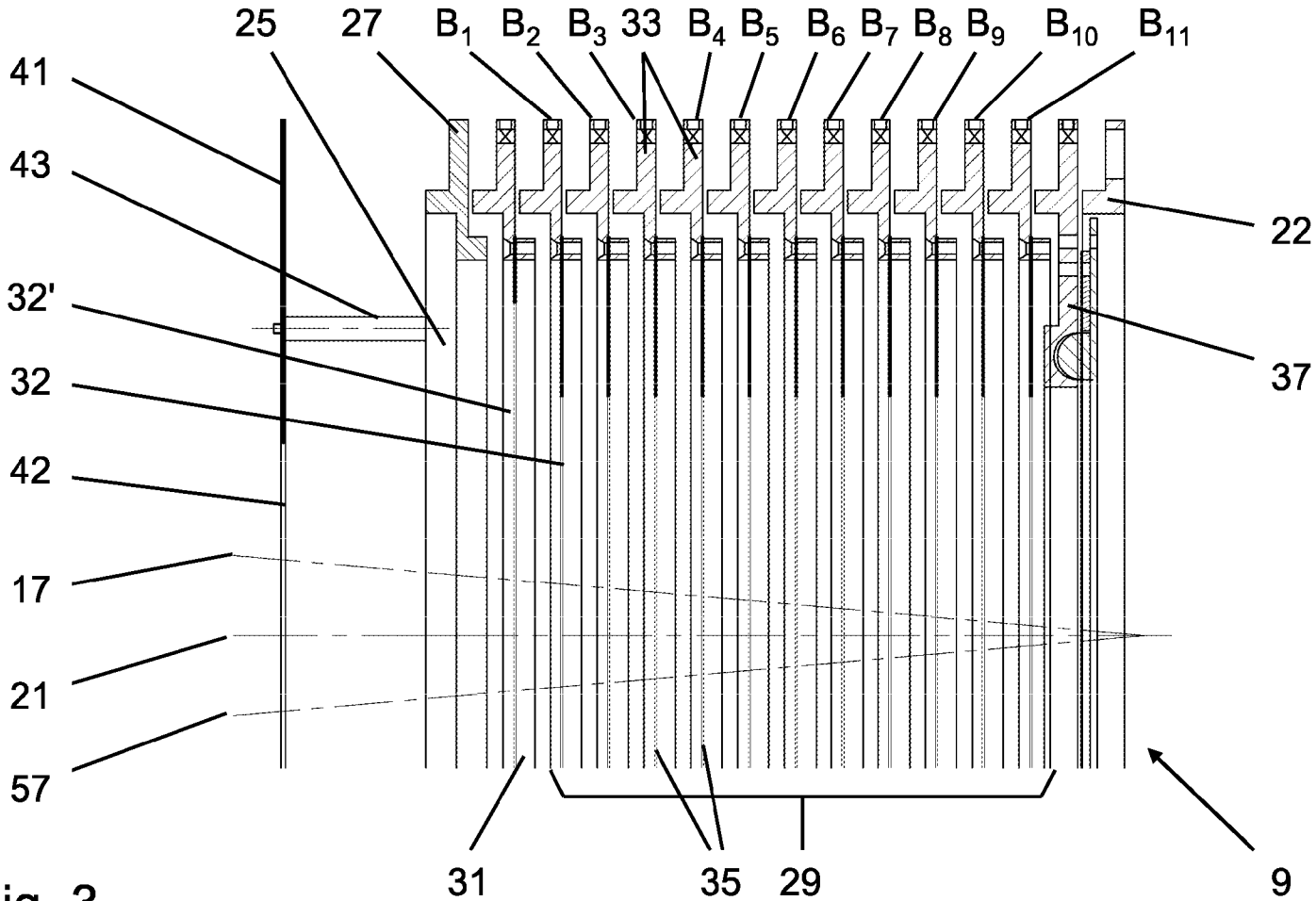
FIG. 3 shows a longitudinal sectional view of the part of the reflector as per the preferred exemplary embodiment.

The exemplary embodiment of a time-of-flight mass spectrometer according to the invention illustrated in FIG. 1 is arranged in a vacuum recipient 1 comprising a plurality of chambers, the walls of which recipient being illustrated by means of dashed lines in the drawing and the recipient being able to be differentially evacuated by a pumping arrangement (not illustrated) such that the entire spectrometer can be operated in a vacuum.

The vacuum recipient 1 comprises a sample chamber 3, an ionization chamber 5 and a reflector chamber 7 with drift paths 53, 59 and the reflector 9. Finally, provision is made for a detector chamber 11, which is embodied as a pipe socket with a flange and in which the detector 55 for registering the ionized atoms and/or molecules deflected by the reflector 9 is arranged.

Furthermore, the time-of-flight mass spectrometer has an ion source 13 for ionizing atoms or molecules, and so the components of a sample, which are firstly introduced into the sample chamber 3 and then transferred into the ionization chamber 5 by means of a gas beam, can be ionized. In the present exemplary embodiment, ionization is brought about with the aid of a pulsed laser (not illustrated), and so ions are only produced at the times prescribed by the laser pulses.

In the preferred exemplary embodiment, the ion source 13 has an electrode arrangement that comprises a repeller electrode 14 and a drain electrode 15 and that accelerates the ionized atoms/molecules along a first direction 17 with the aid of an electric field.

An ion lens 19 adjoins the repeller electrode 14 and the drain electrode 15 along the first direction 17, and said ion lens can be used to bundle in a suitable fashion the ion beam extracted from the ion source 13 with the aid of the repeller electrode 14 and the drain electrode 15 in order to obtain a detection probability in the detector 55 that is as high as possible. The ion lens 19 has a multiplicity of ion-optical elements (not described in any more detail), which are connected to a voltage supply (not illustrated) during operation, and so electric fields act on the transitory ions.

Moreover, the time-of-flight mass spectrometer has an electrostatic reflector 9 for reflecting ions, which extends along a longitudinal axis 21 and is designed as a net-free ion reflector. In this context, the term "net-free" should be understood to mean that the reflector 9 lacks electrodes embodied as nets extending through the path along which the ions move.

The reflector 9 is attached to a flange, which forms the wall of the reflector chamber 7, by means of a supporting ring 22 and mounting rods 23 and has a circular entry opening 25, which in this preferred exemplary embodiment is designed as an annular mount 27, but provision of this mount need not be mandatory. This mount 27 is adjoined by an arrangement of ring electrodes 29, 31 with circular aperture openings 32, 32', which electrodes are arranged parallel to one another. In this preferred embodiment, the ring electrodes 29, 31 each have a ring support 33 and an aperture electrode 35 attached thereto by screws, the latter electrode being provided with the aperture openings 32 or 32'. Here the individual ring electrodes 29, 31 are respectively arranged equidistantly in planes that run perpendicular to the longitudinal axis 21 of the reflector 9.

Moreover, the diameter of the aperture opening 32' of the ring electrode 31 closest to the entry opening 25 in the mount 27 is greater than those in the remaining ring electrodes 29. Finally, at the end remote from the mount 27, the reflector 9 has a reflector electrode 37 and the supporting ring 22 for the mounting rods 23.

According to the invention, the ring electrode closest to the entry opening 25 is embodied as a correction electrode 31 with the same shape as the remaining ring electrodes 29, but provided with a larger aperture opening 32'. The correction electrode 31 lies at a negative potential, which is supplied by a first voltage supply 45 and can typically lie between −1 kV and −4 kV for positively charged ions with a kinetic energy of 1 keV. By contrast, the ring electrodes 29 arranged therebehind in the direction of the reflector electrode 37 are designed as decelerating electrodes for the ions incident on the reflector 9 and lie at a positive potential that increases towards the reflector electrode 37. A second voltage supply 47, likewise illustrated schematically in FIG. 1, can be used so that the ring electrodes 29 lie at mutually differing positive potentials. This can either be brought about by virtue of the fact that the individual ring electrodes 29 are connected to the voltage supply 47 independently from one another, or be brought about by virtue of the fact that the individual ring electrodes 29 are electrically interconnected via resistors, and so the individual ring electrodes 29 each lie on a respectively different potential when a voltage is applied between the first and the last ring electrode 29. Thus the correction electrode 31 can be placed on a freely selectable opposite potential compared to the remaining ring electrodes 29.

Moreover, spaced therefrom, a screening electrode 41 with a likewise annular design and a circular opening 42 is provided on the mount 27, with spacer parts 43 being provided between the mount 27 and the screening electrode 41. The diameter of the through-hole 42 is designed to be smaller than that of the aperture opening 32' in the correction electrode 31. Furthermore, the screening electrode 41 lies at a potential that differs from that of the ring electrodes 29, 31 and, in the present exemplary embodiment, also lies at the potential of the drift paths in the vacuum recipient 1, namely on earth potential, as indicated by earth connections 49, 51.

However, it is also feasible for both the screening electrode 41 and the drift paths 53 and 59 to be placed at a common potential that differs from the potential of the vacuum recipient 1, i.e. preferably differs from the earth potential.

The distance of the screening electrode 41 from the mount 27 and the diameter of the through-hole 42 of the screening electrode 41 are set such that, on the one hand, the electric field of the correction electrode 31 is screened towards the field-gradient-free region of the drift paths 53 and 59 but, on the other hand, the case of ions being incident on the screening electrode 41 is prevented, which would lead to a reduced detection probability as a result of transmission losses. More particularly, in this case the through-hole 42 in the screening electrode 41 is smaller than the aperture opening 32' of the correction electrode 31.

The path length between the ion lens 19 and the reflector 9 serves as a field-gradient-free first drift path 53 for the ions, with the first drift path 53 running along the first direction 17.

The time-of-flight mass spectrometer moreover has a detector 55, which, as seen from the reflector 9, is arranged at a distance from the reflector 9 in a second direction 57. The detector 55 is embodied to register the incidence of ions as a function of time. A field-free second drift path 59 is formed between the reflector 9 and the detector 55, which drift path extends along the second direction 57.

The ion source 13, the repeller electrode 14, the drain electrode 15, the reflector 9 and the detector 55 are arranged in the vacuum recipient 1 such that the first direction 17, the longitudinal axis 21 of the reflector 9 and the second direction 57 run in a common plane. Moreover, the first and the second direction 17, 57 run such that they meet at a point that is situated on the longitudinal axis 21 and lies in a region behind the entry opening 25 of the reflector 9, as seen in the movement direction of the ions emerging from the ion source 13. Finally, the longitudinal axis 21 of the reflector 9 bisects the angle between the first direction 17 and the second direction 57.

The time-of-flight mass spectrometer is operated as follows.

The atoms and/or molecules supplied from the sample chamber 3 by means of a gas beam are ionized, preferably by laser pulses, in the ion source 13. The ionization is not continuous but pulsed, and so there is a defined start time for the time-of-flight measurement. Other methods for ionizing the atoms and/or molecules are also possible, for example matrix-assisted laser desorption/ionization (MALDI), electrospray ionization (ESI) and electron impact ionization.

An electric field of the repeller electrode 14 and the drain electrode 15 accelerates the ions along the first direction 17, and the ion lens 19 directs said ions onto the reflector 9. In the process, the ions obtain the same amount of kinetic energy, independently of their mass, but thereafter they each have different speeds as a result of their different masses. The ions leave the ion source 13 and the ion lens 19 with their respective speed and enter the first field-gradient-free drift path 53, in which they approach the reflector 9 at different speeds.

The ring electrodes 29 of the reflector 9 lie at different positive potentials, wherein the following voltages have been found to be advantageous at the individual apertures, denoted by $B_n$, of the ring electrodes 29 for ions with a kinetic energy of 1 keV with respect to earth potential:

| | |
|---|---|
| $B_1$ | 364 V |
| $B_2$ | 514 V |
| $B_3$ | 630 V |
| $B_4$ | 727 V |
| $B_5$ | 813 V |
| $B_6$ | 891 V |
| $B_7$ | 962 V |
| $B_8$ | 1029 V |
| $B_9$ | 1091 V |
| $B_{10}$ | 1150 V |
| $B_{11}$ | 1206 V |
| Reflector electrode 37 | 1260 V |

Since the electric potential of the ring electrodes 29 and the charge of the ions have the same sign, the entering ions are decelerated in the reflector 9 and are subsequently accelerated in the opposite direction and leave the reflector again. They flow along the second drift path 59, directed along the second direction 57, to the detector 55, where a signal is emitted at the time when an ion is incident, with this signal having a time offset with respect to the laser pulse causing the ionization.

Here this time offset is a measure of the mass of the ion that generated the signal. As a result of their lower speed, ions with a greater mass are incident later on the detector 55 than lighter ions. The ions produced in the ion source 13 generate a multiplicity of signals, and plotting the number of signals as a function of the time offset from the laser pulse represents a mass spectrum of the sample.

As a result of the correction electrode 31 and the screening electrode 41, the first and the second drift paths 53, 59 are in actual fact largely field gradient free, and in these regions the electric field within the reflector 9 has no influence on the movement of the ions, and so the ions are neither accelerated nor decelerated here. The idea of the correction electrode 31 is based on the notion of suppressing the field penetration into the drift paths 53, 59 without there being obstacles in the region of the ion trajectories. The disturbances instead are avoided with the aid of an electric field. The magnitude of the voltage with which the correction electrode 31 is supplied can largely be selected freely, and so this parameter is still available to adapt the angle divergence of the ion beam, reflected in the reflector 9, to the detector geometry. However, it was found to be advantageous, inter alia if use was made of the aforementioned voltages for the aperture electrodes 35 $B_1, \ldots, B_{11}$ of the ring electrodes 29, for the correction electrode 31 to lie at a potential of −2.1 kV and hence between −1 and −4 kV. Such a selection of the potential of the correction electrode 31 combined with the dimensions thereof brings about the effect of firstly avoiding that the field of the further ring electrodes 29 lying at a positive potential spreads into the region of the drift paths 53, 59. Secondly, the electrostatic field of the further ring electrodes 29 is not changed too strongly, and so the speed distribution of an ion packet due to initial energy distributions in the ion source 13 can furthermore be compensated for in the reflector 9.

Hence the use of a correction electrode 31 together with the screening electrode 41 arranged in front of the entry opening 25 leads to significantly smaller edge-field disturbances and hence to an improved mass resolution compared to the prior art.

Figure 5:
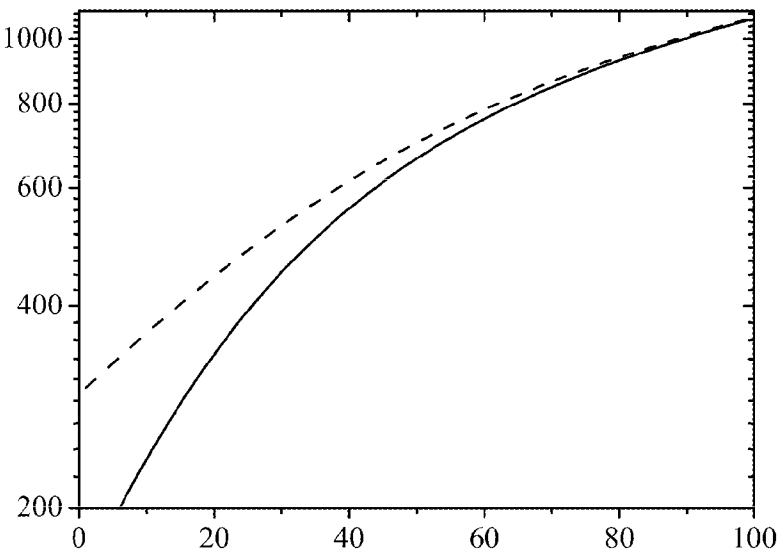
FIG. 5 shows a graph of the magnitude of the electric field in the interior of the reflector as per the preferred exemplary embodiment and FIG. 6 shows a graph of the mass resolution in a mass spectrometer as per the exemplary embodiment compared to the prior art.
Figure 4:
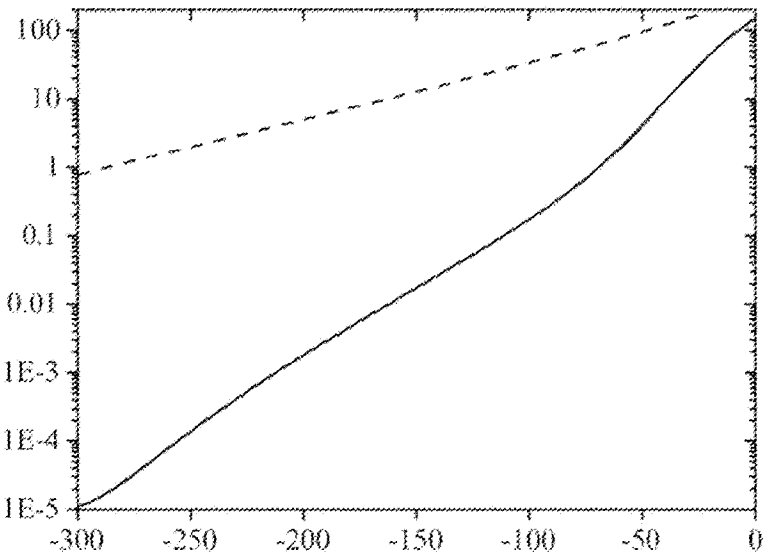
FIG. 4 shows a graph of the magnitude of the electric field in the region in front of the entry opening.

This screening effect is made evident by the two graphs in FIGS. 4 and 5, which show the electrostatic potential in Volts along the longitudinal axis 21 as a function of the distance in millimeters from the plane defined by the entry opening 25, to be precise outside of the reflector 9 or in front of it (FIG. 4) and within the reflector 9 (FIG. 5). Here the solid lines respectively show the profile with screening and correction electrodes 41, 31, while the dashed lines respectively reproduce the profile without the additional electrodes according to the invention. The profile of the solid lines is obtained if the already mentioned potentials are applied to the aperture electrodes 35 $B_1, \ldots, B_{11}$ of the ring electrodes 29.

It becomes evident from these illustrations that the electric field strength in the vicinity of the entry opening itself, and outside, is significantly reduced, wherein it should be pointed out that use has been made of a logarithmic scale in these illustrations.

Figure 6:
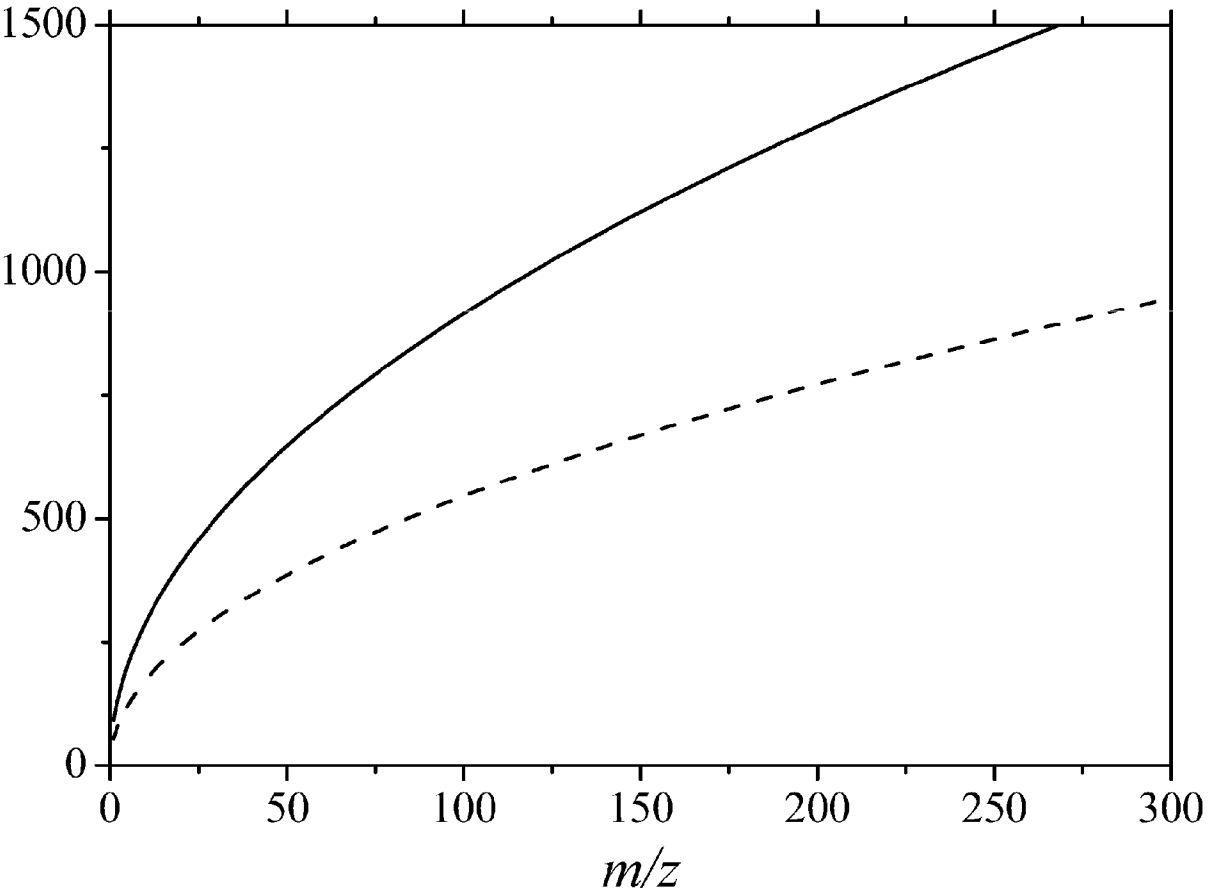

The reduced influence of the field in the reflector 9 on the drift paths 53, 59 is connected with an improvement of the mass resolution, as emerges from FIG. 6. In this illustration, the mass resolution is illustrated as a function of the ratio (m/z) of mass (m) to charge (z) of the ions, with this being plotted once for the case with the screening and correction electrodes (solid line) and once without the use of these electrodes (dashed line).

Hence it is evident from these illustrations that the electrode arrangement according to the invention on the reflector 9 can achieve a significant improvement in the properties of a time-of-flight mass spectrometer, without this being connected with a deterioration of the detection probability in the detector 55.

What is claimed:

1. Reflector for a time-of-flight mass spectrometer for reflecting ionized atoms and/or molecules, said reflector having an entry opening (25) and an arrangement of successively arranged ring electrodes (31, 29) extending away from the entry opening (25) along a longitudinal axis (21) of the reflector (9), wherein the ring electrode (31) closest to the entry opening (25) is at an opposite electric potential compared to the other ring electrodes (29), wherein a screening electrode (41) is provided on a side of the entry opening (25) facing away from the ring electrodes (31, 29) and wherein the screening electrode (41) lies at a potential that differs from that of the ring electrodes (31, 29).

2. Reflector according to claim 1, characterized in that the ring electrodes (31, 29) have aperture openings (32', 32) and wherein the aperture opening (32') of the ring electrode (31) closest to the entry opening (25) is greater than that of the other ring electrodes (29).

3. Reflector according to claim 1, characterized in that the screening electrode (41) has an annular design with an aperture through-hole (42) and extends in a plane running perpendicular to the longitudinal axis (21) of the reflector (9).

4. Reflector according to claim 3, characterized in that the through-hole (42) of the screening electrode (41) is less than or equal to the aperture opening (32') of the ring electrode (31) closest to the entry opening (25).

5. Reflector according to claim 1, characterized in that the distance between the screening electrode (41) and the ring electrode (31) closest to the entry opening (25) can be adjusted.

6. Reflector according to claim 1, characterized in that a mount (27) is provided, which surrounds the entry opening (25), and in that the screening electrode (41) is attached to the mount (27).

7. Reflector according to claim 1, characterized in that the potential of the ring electrode (31) closest to the entry opening (25) lies between −1 kilovolt and −4 kilovolt.

8. Time-of-flight mass spectrometer with an ion source (13) for ionizing atoms and/or molecules, said mass spectrometer having an electrode arrangement (14, 15) for accelerating ionized atoms and/or molecules in a first direction (17) with the aid of electric fields, said mass spectrometer having an electrostatic reflector (9) according to claim 1 for reflecting the ionized atoms and/or molecules travelling along the first direction (17) into a second direction (57), wherein the reflector (9) is arranged such that the longitudinal axis (21) of the reflector (9) bisects the angle between the first and the second direction (17, 57), and further including a detector (55) arranged along the second direction (57) for detecting the incidence of the ionized atoms and/or molecules.

9. The reflector of claim 1, wherein the screening electrode (41) is at earth potential.

10. Reflector according to claim 2, characterized in that the screening electrode (41) has an annular design with an aperture opening (42) and extends in a plane running perpendicular to the longitudinal axis (21) of the reflector (9).

11. Reflector according to claim 2, characterized in that the distance between the screening electrode (41) and the ring electrode (31) closest to the entry opening (25) can be adjusted.

12. Reflector according to claim 4, characterized in that the distance between the screening electrode (41) and the ring electrode (31) closest to the entry opening (25) can be adjusted.

13. Reflector according to claim 4, characterized in that the distance between the screening electrode (41) and the ring electrode (31) closest to the entry opening (25) can be adjusted.

14. Reflector according to claim 2, characterized in that a mount (27) is provided, which surrounds the entry opening (25), wherein the screening electrode (41) is attached to the mount (27).

15. Reflector according to claim 3, characterized in that a mount (27) is provided, which surrounds the entry opening (25), wherein the screening electrode (41) is attached to the mount (27).

16. Reflector according to claim 4, characterized in that a mount (27) is provided, which surrounds the entry opening (25), wherein the screening electrode (41) is attached to the mount (27).

17. Reflector according to claim 5, characterized in that a mount (27) is provided, which surrounds the entry opening (25), wherein the screening electrode (41) is attached to the mount (27).

18. Reflector according to claim 2, characterized in that the potential of the ring electrode (31) closest to the entry opening (25) lies between −1 kilovolt and −4 kilovolt.

19. Reflector according to claim 3, characterized in that the potential of the ring electrode (31) closest to the entry opening (25) lies between −1 kilovolt and −4 kilovolt.

20. Reflector according to claim 4, characterized in that the potential of the ring electrode (31) closest to the entry opening (25) lies between −1 kilovolt and −4 kilovolt.

* * * * *